US011047624B2

(12) United States Patent
Sakita et al.

(10) Patent No.: US 11,047,624 B2
(45) Date of Patent: Jun. 29, 2021

(54) COATING DRYING FURNACE

(71) Applicant: Taikisha Ltd., Tokyo (JP)

(72) Inventors: Kenji Sakita, Tokyo (JP); Hiroshi Iwakiri, Tokyo (JP)

(73) Assignee: Taikisha Ltd., Tokyo (JP)

( * ) Notice: Subject to any disclaimer, the term of this patent is extended or adjusted under 35 U.S.C. 154(b) by 52 days.

(21) Appl. No.: 16/604,646

(22) PCT Filed: Apr. 26, 2018

(86) PCT No.: PCT/JP2018/017029
§ 371 (c)(1),
(2) Date: Oct. 11, 2019

(87) PCT Pub. No.: WO2018/230180
PCT Pub. Date: Dec. 20, 2018

(65) Prior Publication Data

US 2020/0158432 A1 May 21, 2020

(30) Foreign Application Priority Data

Jun. 16, 2017 (JP) ..... JP2017-118852

(51) Int. Cl.
*F26B 21/00* (2006.01)
*F26B 25/08* (2006.01)

(52) U.S. Cl.
CPC ..... *F26B 21/004* (2013.01); *F26B 21/00* (2013.01); *F26B 25/08* (2013.01); *F26B 2210/12* (2013.01)

(58) Field of Classification Search
CPC ..... F26B 21/004; F26B 21/00; F26B 25/00; F26B 25/08; F26B 2210/00; F26B 2210/12
(Continued)

(56) References Cited

U.S. PATENT DOCUMENTS 1,606,442 A * 11/1926 Nichols ..... F26B 25/008 34/230
RE18,645 E * 11/1932 Whitmore ..... B05B 16/60 454/51
(Continued)

FOREIGN PATENT DOCUMENTS

JP 2000334367 A 12/2000
JP 2013519856 A 5/2013
(Continued)

*Primary Examiner* — Stephen M Gavini
(74) *Attorney, Agent, or Firm* — The Webb Law Firm

(57) ABSTRACT

Leaking of high-temperature gas inside a furnace to the outside of the furnace via a furnace body opening portion and entry of normal-temperature air outside the furnace into the furnace via the furnace body opening portion are effectively prevented. A central vent that forms an airflow curtain in a target object passage region of a furnace body opening portion and left and right side vents that form airflow curtains respectively in gap regions between the target object passage region and left and right side walls of the furnace body opening portion are provided as vents for forming airflow curtains, an airflow fa for forming an airflow curtain blows from the central vent toward the inner side of the furnace diagonally downward at an inclination angle that is smaller than 40° relative to a horizontal direction, and airflows for forming airflow curtains blow from the left and right side vents vertically downward or toward the inner side of the furnace diagonally downward at an inclination angle that is larger than 60° relative to the horizontal direction.

8 Claims, 13 Drawing Sheets

(58) Field of Classification Search
USPC ..... 34/666
See application file for complete search history.

(56) References Cited

U.S. PATENT DOCUMENTS

| | | | | |
|---|---|---|---|---|
| 4,338,364 | A * | 7/1982 | Kennon | B05B 16/90 427/424 |
| 5,568,692 | A * | 10/1996 | Crompton | F26B 3/283 34/270 |
| 5,657,555 | A * | 8/1997 | Milojevic | F26B 3/283 34/271 |
| 6,760,981 | B2 * | 7/2004 | Leap | F26B 15/18 34/210 |
| 7,600,329 | B2 * | 10/2009 | Ortlieb | B65G 13/02 34/666 |
| 7,658,017 | B1 * | 2/2010 | Laviolette | F26B 5/042 34/403 |
| 8,658,240 | B2 * | 2/2014 | Fritz | B08B 17/04 427/8 |
| 8,756,827 | B1 * | 6/2014 | Calabro | B05B 16/60 34/487 |
| 8,997,374 | B2 * | 4/2015 | Sato | F26B 3/283 34/270 |
| 9,074,769 | B2 * | 7/2015 | Suljak | F23J 13/08 |
| 9,296,363 | B2 * | 3/2016 | Pihlblad | F26B 3/28 |
| 9,649,613 | B2 * | 5/2017 | Kantor | C10B 53/07 |
| 9,970,706 | B2 * | 5/2018 | Wieland | F26B 25/008 |
| 10,605,529 | B2 * | 3/2020 | Wieland | F26B 15/14 |
| 2011/0179751 | A1 * | 7/2011 | Caudwell | B65B 53/04 53/427 |
| 2013/0232801 | A1 | 9/2013 | Wieland et al. | |
| 2015/0121720 | A1 | 5/2015 | Wieland et al. | |
| 2019/0217320 | A1 * | 7/2019 | Schulze | B05D 3/02 |
| 2020/0158432 | A1 * | 5/2020 | Sakita | F26B 21/04 |
| 2020/0215570 | A1 * | 7/2020 | Beaudry | B05D 3/007 |

FOREIGN PATENT DOCUMENTS

| | | | | |
|---|---|---|---|---|
| JP | 2019002641 | A * | 1/2019 | F24F 9/00 |
| JP | 6681853 | B2 * | 4/2020 | F24F 9/00 |
| WO | 2013164285 | A1 | 11/2013 | |
| WO | WO-2018230180 | A1 * | 12/2018 | F26B 25/08 |

* cited by examiner

COATING DRYING FURNACE

CROSS-REFERENCE TO RELATED APPLICATIONS

This application is the United States national phase of International Application No. PCT/JP2018/017029 filed Apr. 26, 2018, and claims priority to Japanese Patent Application No. 2017-118852 filed Jun. 16, 2017, the disclosures of which are hereby incorporated by reference in their entirety.

TECHNICAL FIELD

The present invention relates to a coating drying furnace in which a process target object such as the body of an automobile that has undergone a coating process is subjected to a coating drying process.

More specifically, the present invention relates to a coating drying furnace in which vents for forming airflow curtains are provided in a ceiling portion of a furnace body opening portion through which a process target object to be conveyed from the outside to the inside of the furnace or a processed process target object to be conveyed from the inside to the outside of the furnace passes, and airflow curtains that are formed in the furnace body opening portion by airflows blowing from the vents prevent high-temperature gas inside the furnace from leaking to the outside of the furnace via the furnace body opening portion and prevent normal-temperature air outside the furnace from entering the furnace via the furnace body opening portion.

BACKGROUND ART

Patent Document 1 below proposes a conventional coating drying furnace (see FIG. 24) in which an airflow f for forming an airflow curtain blows from a vent S for forming an airflow curtain, which is provided in a ceiling portion of a furnace body opening portion 2, toward the inner side of the furnace diagonally downward at an inclination angle θ of 40° to 60° relative to a horizontal direction to form an airflow curtain C that is inclined at a constant angle across the entire width of the furnace body opening portion 2 in its transverse direction (the direction toward the back side of the sheet of FIG. 24).

PRIOR ART DOCUMENTS

Patent Documents

Patent Document 1: JP 2013-519856A (in particular, paragraphs [0018] to and FIGS. 1 to 3)

DISCLOSURE OF THE INVENTION

Problem to be Solved by the Invention

Incidentally, in the furnace body opening portion 2 of the coating drying furnace through which a process target object passes, essentially, high-temperature gas G inside the furnace leaks to the outside of the furnace via an upper region of the furnace body opening portion 2 due to the stack effect, as schematically shown in FIG. 23.

At the same time, normal-temperature air O outside the furnace enters the furnace via a lower region of the furnace body opening portion 2.

Such leaking of high-temperature gas G from the inside to the outside of the furnace and entry of normal-temperature air O from the outside to the inside of the furnace lead to a large heat loss and increase energy consumption and operating cost.

With regard to this, FIGS. 24 to 27 show airflow states and temperature distribution states in a case where an airflow f for forming an airflow curtain blows from the vent S for forming an airflow curtain, which is provided in the ceiling portion of the furnace body opening portion 2, toward the inner side of the furnace diagonally downward at an inclination angle θ of 55° (40°<θ<60°) relative to the horizontal direction.

FIGS. 24 and 25 respectively show an airflow state and a temperature distribution state in a case where there is no process target object in a target object passage region of the furnace body opening portion 2.

On the other hand, FIGS. 26 and 27 respectively show an airflow state and a temperature distribution state in a case where a process target object B is in the target object passage region of the furnace body opening portion 2.

As is clear from these figures, if the technology proposed in Patent Document 1 is employed, in a situation (FIGS. 26 and 27) in which the process target object B is in the target object passage region of the furnace body opening portion 2, the airflow f blowing from the vent S provided in the ceiling portion collides with an upper surface portion of the process target object B and largely rebounds in a state of still having a high speed.

Therefore, the airflow curtain C is largely disturbed near the upper surface portion of the process target object B.

As a result, high-temperature gas G inside the furnace leaks to the outside of the furnace via an upper region of the furnace body opening portion 2. Furthermore, while high-temperature gas G inside the furnace leaks, normal-temperature air O outside the furnace enters the furnace via a space under the process target object B.

Such leaking of high-temperature gas G from the inside to the outside of the furnace and entry of normal-temperature air O from the outside to the inside of the furnace occur every time a process target object B passes through the furnace body opening portion 2.

Therefore, in spite of the airflow curtain C being formed, heat loss via the furnace body opening portion 2 is still a serious problem.

In view of the above circumstances, a main problem to be solved by the present invention is to more reliably prevent the above-described leaking of high-temperature gas inside the furnace to the outside of the furnace and entry of normal-temperature air outside the furnace into the furnace via the furnace body opening portion, by employing a rational airflow blowing manner for forming airflow curtains.

Means for Solving Problem

A first characteristic configuration of the present invention relates to a coating drying furnace, and is characterized in that vents for forming airflow curtains are provided in a ceiling portion of a furnace body opening portion through which a process target object to be conveyed from the outside to the inside of the furnace or a processed process target object to be conveyed from the inside to the outside of the furnace passes, and airflow curtains that are formed in the furnace body opening portion by airflows blowing from the vents prevent high-temperature gas inside the furnace from leaking to the outside of the furnace via the furnace body opening portion and prevent normal-temperature air outside the furnace from entering the furnace via the furnace body opening portion, the coating drying furnace including, as the vents:

a central vent configured to form an airflow curtain in a target object passage region of the furnace body opening portion; and left and right side vents configured to form airflow curtains respectively in gap regions between the target object passage region and left and right side walls of the furnace body opening portion, wherein an airflow for forming an airflow curtain blows from the central vent toward the inner side of the furnace diagonally downward at an inclination angle that is smaller than 40° relative to a horizontal direction, and airflows for forming airflow curtains blow from the left and right side vents vertically downward or toward the inner side of the furnace diagonally downward at an inclination angle that is larger than 60° relative to the horizontal direction.

According to this configuration, if a process target object B is in a target object passage region 2*a* of a furnace body opening portion 2 (see FIGS. 6 and 7), an airflow fa for forming an airflow curtain that blows from a central vent 4 flows along an upper surface portion of the process target object B, because the inclination angle θa relative to the horizontal direction is smaller than 40° and an incident angle θin relative to the upper surface portion of the process target object B is large.

Therefore, the airflow fa for forming an airflow curtain blowing from the central vent 4 is kept from rebounding after colliding with the upper surface portion of the process target object B.

As a result, the airflow fa blowing from the central vent 4 stably forms an airflow curtain Ca, which is not disturbed, above the process target object B.

Therefore, if the process target object B is in the target object passage region 2*a* of the furnace body opening portion 2, leaking of high-temperature gas G from the inside to the outside of the furnace via an upper region of the furnace body opening portion 2 is effectively prevented by the airflow curtain Ca that is formed above the process target object B by the airflow fa blowing from the central vent 4 and airflow curtains Cb that are respectively formed in gap regions 2*b* between the target object passage region 2*a* and side walls 6 by airflows fb blowing from left and right side vents 5.

Furthermore, since the airflows fb blowing from the left and right side vents 5 are oriented vertically downward or diagonally downward at the inclination angle θb that is larger than 60° relative to the horizontal direction, the airflows fb reach floor portions in the respective gap regions 2*b* while forming the airflow curtains Cb in the gap regions 2*b*, and thereafter portions of the airflows fb effectively flow into a space under the process target object B.

The thus formed airflows fb' flowing into the space under the process target object prevent normal-temperature air O outside the furnace from passing under the process target object B and entering the furnace.

Therefore, if the process target object B is in the target object passage region 2*a* of the furnace body opening portion 2, entry of normal-temperature air O from the outside to the inside of the furnace via a lower region of the furnace body opening portion 2 is effectively prevented by the airflow curtains Cb that are respectively formed in the gap regions 2*b* by the airflows fb blowing from the left and right side vents 5 and the above-described airflows fb' flowing into the space under the process target object B from the floor portions of the respective gap regions 2*b*.

On the other hand, if there is no vehicle body B in the furnace body opening portion 2 (see FIGS. 4 and 5), an airflow fa blowing from the central vent 4 toward the inner side of the furnace diagonally downward at the inclination angle θa that is smaller than 40° relative to the horizontal direction forms an airflow curtain Ca in the target object passage region 2*a* while flowing diagonally downward because there is no process target object B, and the airflow fa blowing from the central vent 4 also spreads in the transverse direction of the furnace body opening portion 2 toward the gap regions 2*b*, while forming the airflow curtain Ca, because there is no process target object B.

Further, airflows fb blowing from the left and right side vents 5 vertically downward or toward the inner side of the furnace diagonally downward at the inclination angle θb that is larger than 60° relative to the horizontal direction form airflow curtains Cb respectively in the gap regions 2*b* and, on the outer sides of the furnace with respect to the airflow curtain Ca formed by the airflow fa blowing from the central vent 4, the airflows fb blowing from the left and right side vents 5 also spread in the transverse direction of the furnace body opening portion 2 toward the target object passage region 2*a*, while forming the airflow curtains Cb, because there is no process target object B.

Therefore, if there is no process target object B in the furnace body opening portion 2, the state of the entire furnace body opening portion 2 can be made close to a state where double airflow curtains are formed therein.

As a result, leaking of high-temperature gas G from the inside to the outside of the furnace via the upper region of the furnace body opening portion 2 and entry of normal-temperature air O from the outside to the inside of the furnace via the lower region of the furnace body opening portion 2 are effectively prevented.

For the above-described reasons, according to the above-described first characteristic configuration, leaking of high-temperature gas inside the furnace to the outside of the furnace via the furnace body opening portion and entry of normal-temperature air outside the furnace into the furnace via the furnace body opening portion are more reliably prevented, compared to the coating drying furnace proposed in the above-described Patent Document 1.

As a result, heat loss via the furnace body opening portion is more effectively reduced.

It should be noted that FIGS. 8 and 9 show temperature distribution states in the target object passage region 2*a* of the furnace body opening portion 2 in a case where an airflow fa for forming an airflow curtain blows from the central vent 4 toward the inner side of the furnace diagonally downward at an inclination angle θa of 35° relative to the horizontal direction and airflows fb for forming airflow curtains blow from the left and right side vents 5 toward the inner side of the furnace diagonally downward at an inclination angle θb of 80° relative to the horizontal direction.

Here, FIG. 8 shows a temperature distribution state in a case where there is no process target object B in the target object passage region 2*a* of the furnace body opening portion 2.

FIG. 9 shows a temperature distribution state in a case where a process target object B is in the target object passage region 2*a* of the furnace body opening portion 2.

As is clear from FIGS. 8 and 9, according to the above-described first characteristic configuration, leaking of high-temperature gas G from the inside to the outside of the furnace via the furnace body opening portion 2 and entry of normal-temperature air O from the outside to the inside of the furnace via the furnace body opening portion 2 are effectively prevented in both the case where there is no process target object B in the furnace body opening portion 2 and the case where the process target object B is in the furnace body opening portion 2.

A second characteristic configuration of the present invention specifies a preferable embodiment when implementing the first characteristic configuration, and is characterized in that an inclination angle of an airflow blowing from the central vent relative to the horizontal direction is an inclination angle at which heat loss via the furnace body opening portion is minimum in a correlation between the inclination angle and the heat loss.

The relationship between the direction of an airflow blowing from the central vent and the heat loss via the furnace body opening portion was examined, and it was found that there is a correlation, as shown in the graph in FIG. 10, between the inclination angle θa of an airflow blowing from the central vent relative to the horizontal direction and the heat loss via the furnace body opening portion per unit time, unit area, and unit temperature (=opening loss ΔR per unit) in a state where the inclination angle θb of airflows blowing from the left and right side vents relative to the horizontal direction is fixed at a constant angle.

Therefore, according to the above-described second characteristic configuration that employs, as the inclination angle θa of an airflow blowing from the central vent relative to the horizontal direction, an inclination angle at which the heat loss (=opening loss ΔR per unit) is minimum in the above-described correlation, the heat loss via the furnace body opening portion is more effectively reduced when the above-described first characteristic configuration is implemented.

A third characteristic configuration of the present invention specifies a preferable embodiment when implementing the first or second characteristic configuration, and is characterized in that an inclination angle of airflows blowing from the side vents relative to the horizontal direction is an inclination angle at which heat loss via the furnace body opening portion is minimum in a correlation between the inclination angle and the heat loss.

The relationship between the direction of airflows blowing from the side vents and the heat loss via the furnace body opening portion was examined, and it was found that there is a correlation, as shown in the graph in FIG. 11, between the inclination angle θb of airflows blowing from the side vents relative to the horizontal direction and the heat loss via the furnace body opening portion per unit time, unit area, and unit temperature (=opening loss ΔR per unit) in a state where the inclination angle θa of an airflow blowing from the central vent relative to the horizontal direction is fixed at a constant angle.

Therefore, according to the above-described third characteristic configuration that employs, as the inclination angle θb of airflows blowing from the side vents relative to the horizontal direction, an inclination angle at which the heat loss (=opening loss ΔR per unit) is minimum in the above-described correlation, the heat loss via the furnace body opening portion is more effectively reduced when the above-described first characteristic configuration is implemented.

A fourth characteristic configuration of the present invention specifies a preferable embodiment when implementing any of the first to third characteristic configurations, and is characterized in that, in a region of the furnace body opening portion that is located further toward the inner side of the furnace with respect to locations where the airflow curtains are formed, an exhaust port for discharging gas from the region is provided.

When airflows blow from the central vent and the side vents, the airflows enter the region of the furnace body opening portion that is located further toward the inner side of the furnace with respect to locations where the airflow curtains are formed, and as a result, gas in the region diffuses toward the inner side of the furnace and mixes with high-temperature gas inside the furnace. According to the above-described configuration, however, such mixing is prevented as a result of the gas being discharged from the above-described exhaust port.

Therefore, the internal temperature of the furnace is prevented from being reduced as a result of the above-described mixing, and is more stably kept at a temperature that is suitable for drying a coating.

It should be noted that FIG. 15 shows a temperature distribution state in the furnace body opening portion 2 and an inner portion of the furnace in a case where such an exhaust port is not provided.

Also, FIG. 16 shows a temperature distribution state in the furnace body opening portion 2 and the inner portion of the furnace in a case where such an exhaust port 7 is provided.

As is clear from FIGS. 15 and 16, a reduction in the internal temperature of the furnace as a result of the above-described mixing is effectively prevented according to the above-described fourth characteristic configuration.

A fifth characteristic configuration of the present invention specifies a preferable embodiment when implementing any of the first to fourth characteristic configurations, and is characterized in that, in a target object conveyance direction, the central vent is located further toward the inner side of the furnace than the side vents are located, and a spacing distance between the central vent and the side vents in the target object conveyance direction is a spacing distance at which heat loss via the furnace body opening portion is minimum in a correlation between the spacing distance and the heat loss.

The relationship between a relative positional relationship between the central vent and the side vents and the heat loss via the furnace body opening portion was examined, and it was found that there is a correlation, as shown in the graph in FIG. 12, between a spacing distance x between these vents in the target object conveyance direction and the heat loss via the furnace body opening portion per unit time, unit area, and unit temperature (=opening loss ΔR per unit) in a state where the central vent is located further toward the inner side of the furnace than the side vents are located, in the target object conveyance direction.

Therefore, in a configuration in which the central vent is located further toward the inner side of the furnace than the side vents are located in the target object conveyance direction, according to the above-described fifth characteristic configuration that employs, as the spacing distance x between the central vent and the side vents in the target object conveyance direction, a spacing distance at which the heat loss (=opening loss ΔR per unit) is minimum in the above-described correlation, the heat loss via the furnace body opening portion is more effectively reduced when the above-described first characteristic configuration is implemented.

A sixth characteristic configuration of the present invention specifies a preferable embodiment when implementing any of the first to fifth characteristic configurations, and is characterized in that a magnitude of an airflow blowing velocity at the central vent and a magnitude of an airflow blowing velocity at the side vents are equal to each other.

The relationship between the heat loss via the furnace body opening portion and magnitudes of the airflow blowing velocities at the central vent and the side vents was examined, and it was found that the heat loss via the furnace body opening portion tends to increase with an increase in the difference between the magnitude of the airflow blowing velocity at the central vent and the magnitude of the airflow blowing velocity at the side vents.

Therefore, according to the above-described sixth characteristic configuration in which the magnitude of the airflow blowing velocity at the central vent and the magnitude of the airflow blowing velocity at the side vents are equal to each other, the heat loss via the furnace body opening portion is more effectively reduced when the above-described first characteristic configuration is implemented.

It should be noted that, as for the case where the magnitude of the airflow blowing velocity at the central vent and the magnitude of the airflow blowing velocity at the side vents are equal to each other, the relationship between the magnitude of the airflow blowing velocity and the heat loss via the furnace body opening portion was examined, and it was found that there is a correlation, as shown in the graph in FIG. 13, between the magnitude |v| of the airflow blowing velocity and the heat loss via the furnace body opening portion per unit time, unit area, and unit temperature (=opening loss ΔR per unit).

Therefore, if a magnitude at which the heat loss (=opening loss ΔR, per unit) is minimum in the above-described correlation is selected as the magnitude |v| of the airflow blowing velocity at each of the central vent and the side vents when implementing the above-described sixth characteristic configuration, the heat loss via the furnace body opening portion is more effectively reduced when the above-described first characteristic configuration is implemented.

A seventh characteristic configuration of the present invention specifies a preferable embodiment when implementing any of the first to sixth characteristic configurations, and is characterized in that airflows that are heated to a set temperature by a heating means blow from the central vent and the side vents.

That is, high-temperature gas inside the furnace contains tar components that are evaporated from a coating of the process target object, and tar generated through condensation of the tar components due to a reduction in temperature is likely to attach to portions of the furnace body opening portion.

Therefore, tar attaching to the furnace body opening portion needs to be removed, and this increases the burden of carrying out maintenance on the drying furnace.

However, according to the above-described seventh characteristic configuration, airflows heated to a set temperature blow from the central vent and the side vents, and therefore condensation of tar components in the furnace body opening portion is prevented by the heat retained in the heated airflows.

Therefore, the burden of carrying out maintenance on the drying furnace is reduced.

An eighth characteristic configuration of the present invention specifies a preferable embodiment when implementing any of the first to seventh characteristic configurations, and is characterized in that the process target object is a body of an automobile.

BEST MODE FOR CARRYING OUT THE INVENTION

Figure 1:
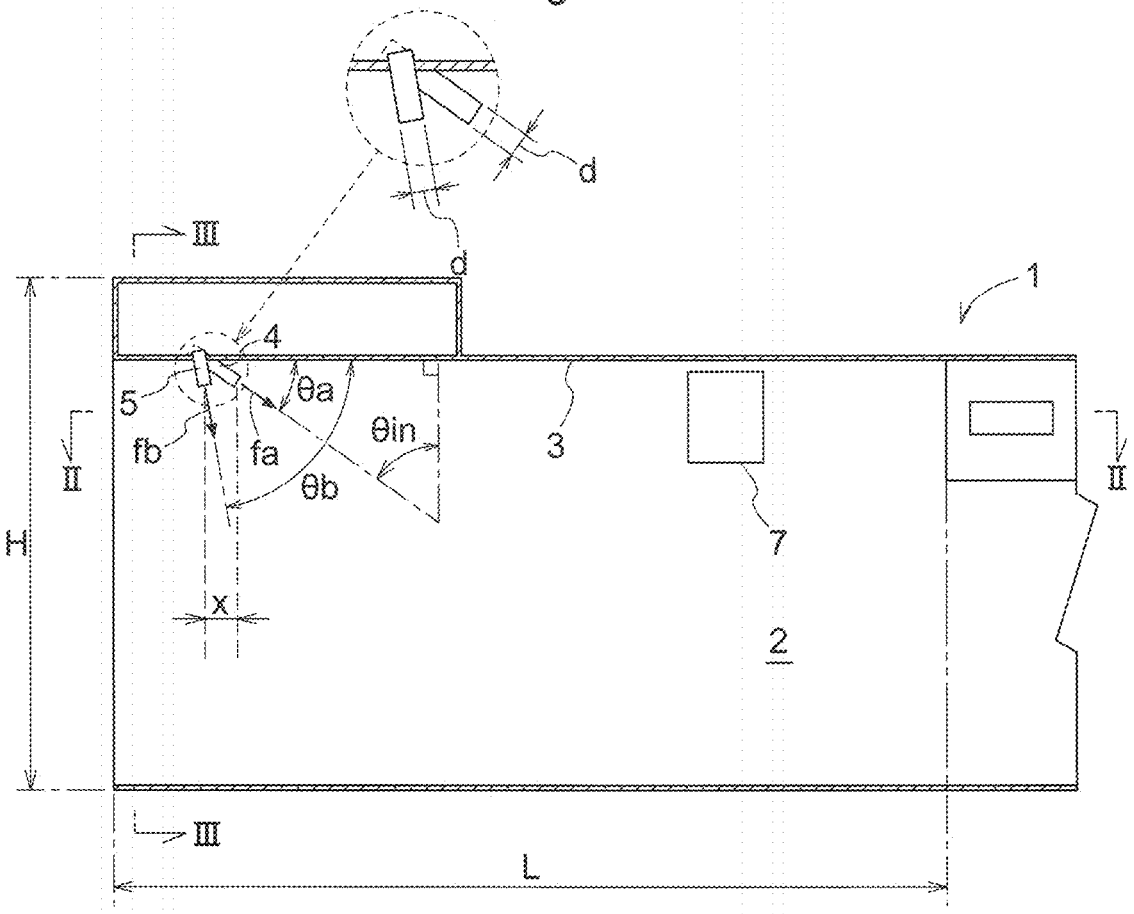
FIG. 1 is a cross-sectional side view of a furnace body opening portion of a coating drying furnace.
Figure 2:
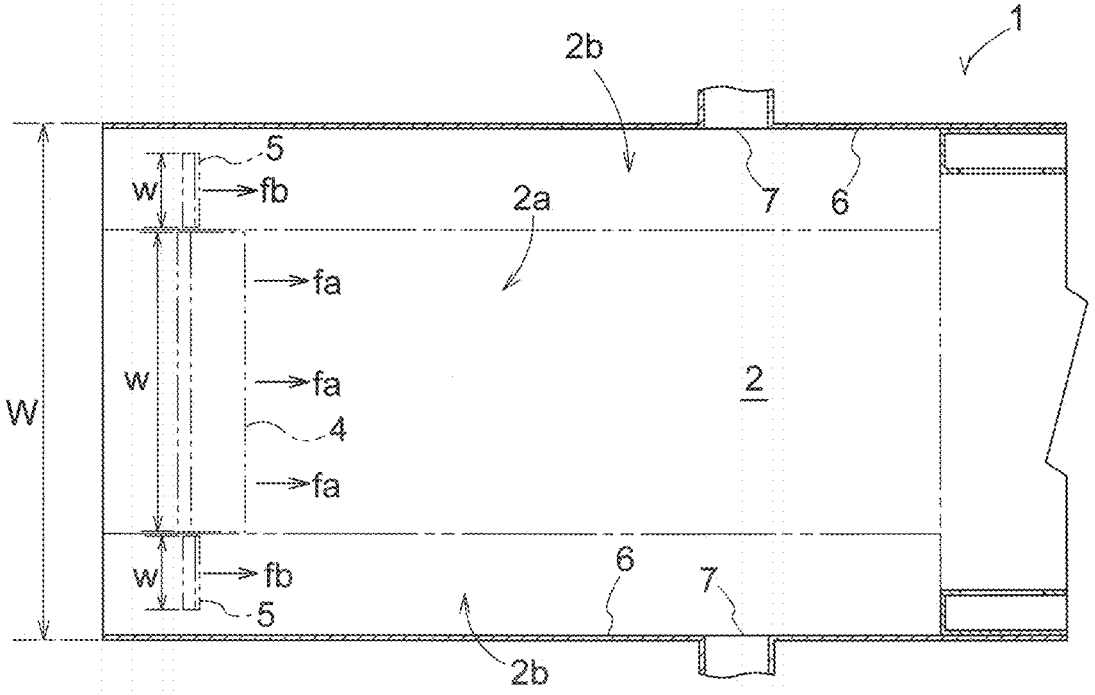
FIG. 2 is a cross-sectional view taken along line II-II in FIG. 1.
Figure 3:
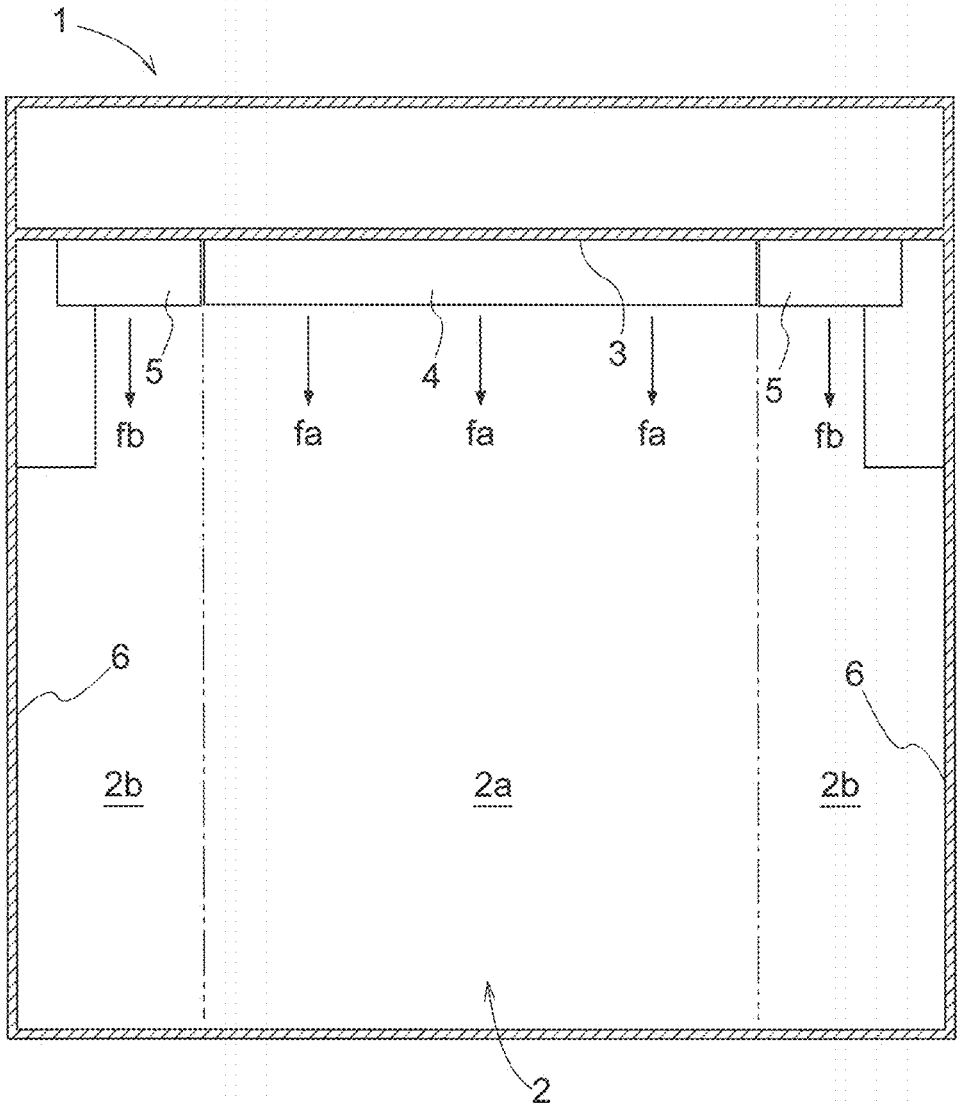
FIG. 3 is a cross-sectional view taken along line III-III in FIG. 1.

FIGS. 1 to 3 show a furnace body opening portion 2 that is located at an end portion of a tunnel-shaped furnace body 1 of a coating drying furnace.

The furnace body opening portion 2 is provided at both an inlet-side end portion and an outlet-side end portion of the tunnel-shaped furnace body 1.

That is, a process target object B (in this example, the body of an automobile) that has undergone a coating step is conveyed into the furnace via an inlet-side furnace body opening portion 2 and is subjected to a coating drying process in the furnace.

Also, a processed process target object B that has been subjected to the coating drying process in the furnace is conveyed to the outside of the furnace via an outlet-side furnace body opening portion 2.

It should be noted that the same structure is employed in both of the inlet-side and outlet-side furnace body opening portions 2 to prevent leaking of high-temperature gas G inside the furnace and entry of normal-temperature air O outside the furnace.

Therefore, the following describes the furnace body opening portion 2 without distinguishing between the inlet side and the outlet side, unless otherwise stated.

Figure 23:
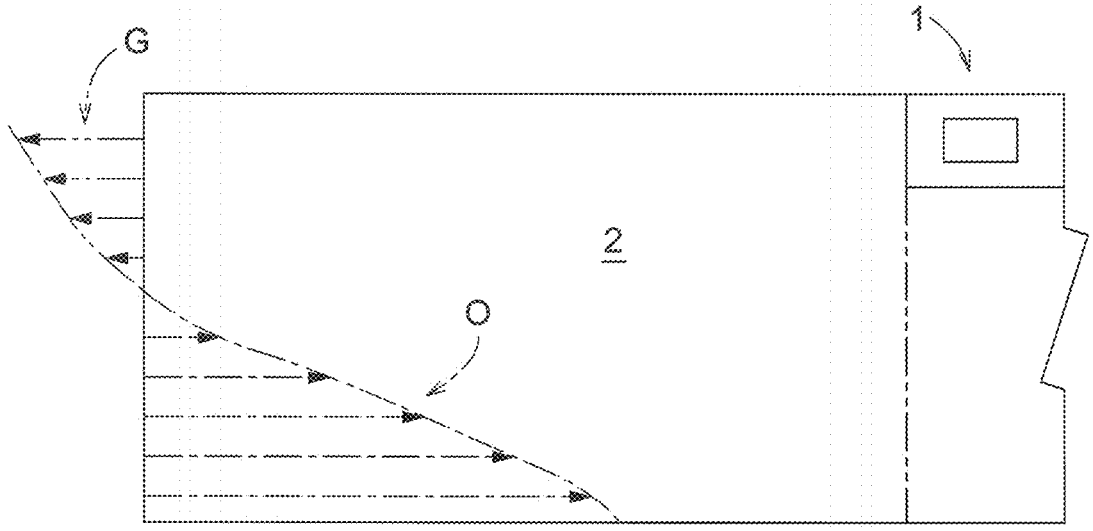
FIG. 23 is a side view showing a state of leaking of high-temperature gas inside the furnace and a state of entry of normal-temperature air outside the furnace.
Figure 24:
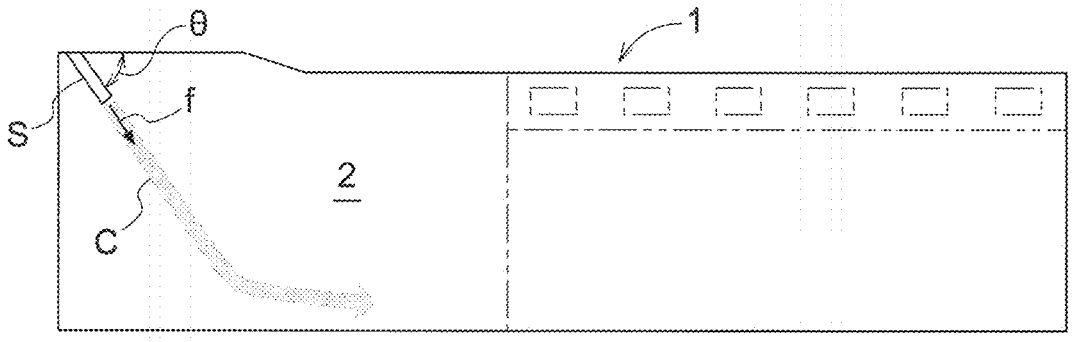
FIG. 24 is a side view showing an airflow state when there is no target object, in a conventional technology.
Figure 25:
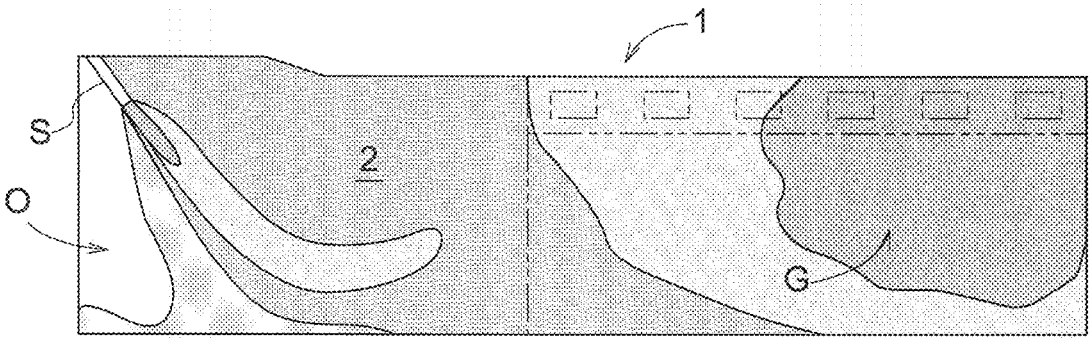
FIG. 25 is a side view showing a temperature distribution state when there is no target object, in a conventional technology.
Figure 26:
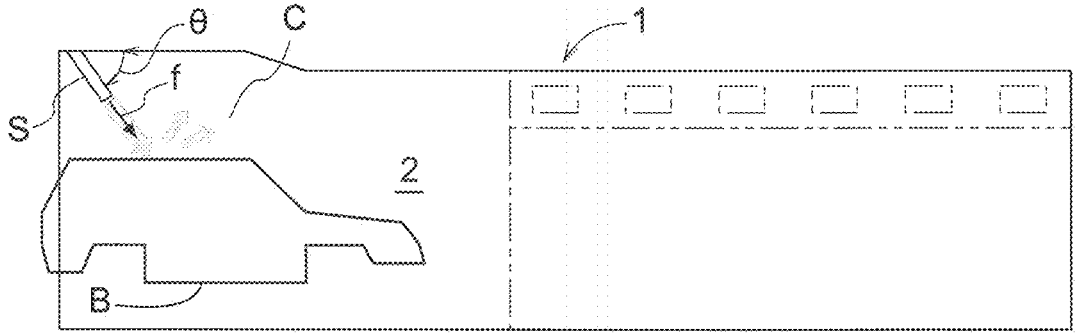
FIG. 26 is a side view showing an airflow state when there is a target object, in a conventional technology.
Figure 27:
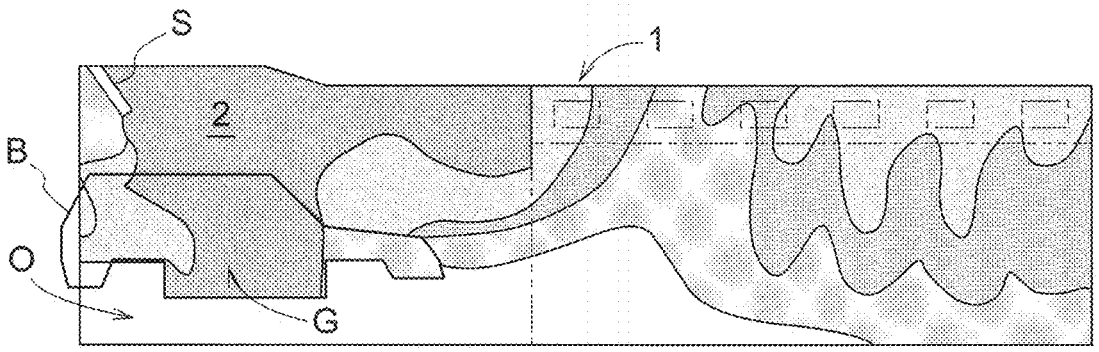
FIG. 27 is a side view showing a temperature distribution state when there is a target object, in a conventional technology.

Incidentally, in the furnace body opening portion 2, high-temperature gas G inside the furnace leaks to the outside of the furnace via an upper region of the furnace body opening portion 2 due to the stack effect, as schematically shown in FIG. 23.

Also, while high-temperature gas G inside the furnace leaks to the outside of the furnace, normal-temperature air O outside the furnace enters the furnace via a lower region of the furnace body opening portion 2.

Such leaking of high-temperature gas G from the inside to the outside of the furnace and entry of normal-temperature air O from the outside to the inside of the furnace via the furnace body opening portion 2 lead to a large heat loss in the coating drying furnace.

To address this, in a furnace outer side edge portion of a ceiling portion 3 of the furnace body opening portion 2, a central vent 4 that serves as a vent for forming an airflow curtain is provided in a central portion in the left-right direction that is the transverse direction of the furnace body opening portion 2, and side vents 5 that serve as vents for forming airflow curtains are provided adjacent to the central vent 4 on both sides thereof in the left-right direction.

An airflow fa blowing from the central vent 4 forms an airflow curtain Ca in a target object passage region 2*a* that is located at the center in the left-right direction of the furnace body opening portion 2.

Also, airflows fb blowing from the left and right side vents 5 form airflow curtains Cb respectively in gap regions 2*b* between the target object passage region 2*a* and side walls 6 of the furnace body opening portion 2.

That is, the airflow curtain Ca formed in the target object passage region 2*a* and the airflow curtains Cb formed in the respective gap regions 2*b* prevent high-temperature gas G inside the furnace from leaking to the outside of the furnace via the furnace body opening portion 2 and normal-temperature air O outside the furnace from entering the furnace via the furnace body opening portion 2.

An airflow fa blows from the central vent 4 toward the inner side of the furnace diagonally downward at an inclination angle θa that is smaller than 40° (θa<40°) relative to the horizontal direction.

On the other hand, an airflow fb blows from each of the left and right side vents 5 toward the inner side of the furnace diagonally downward at an inclination angle θb that is larger than 60° (θb>60°) relative to the horizontal direction.

Figure 6:
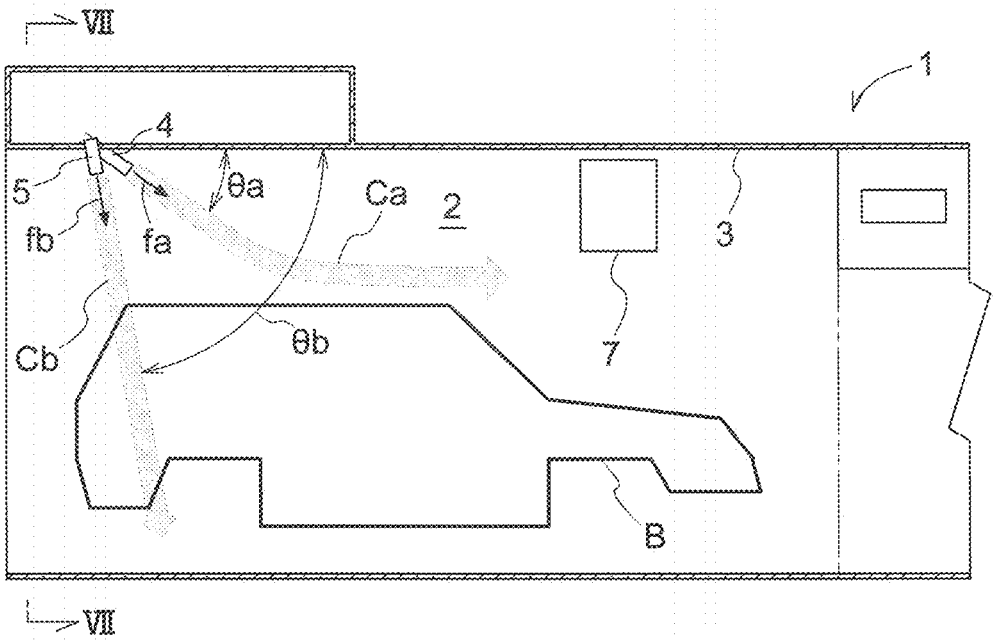
FIG. 6 is a side view showing an airflow state when there is a target object.
Figure 7:
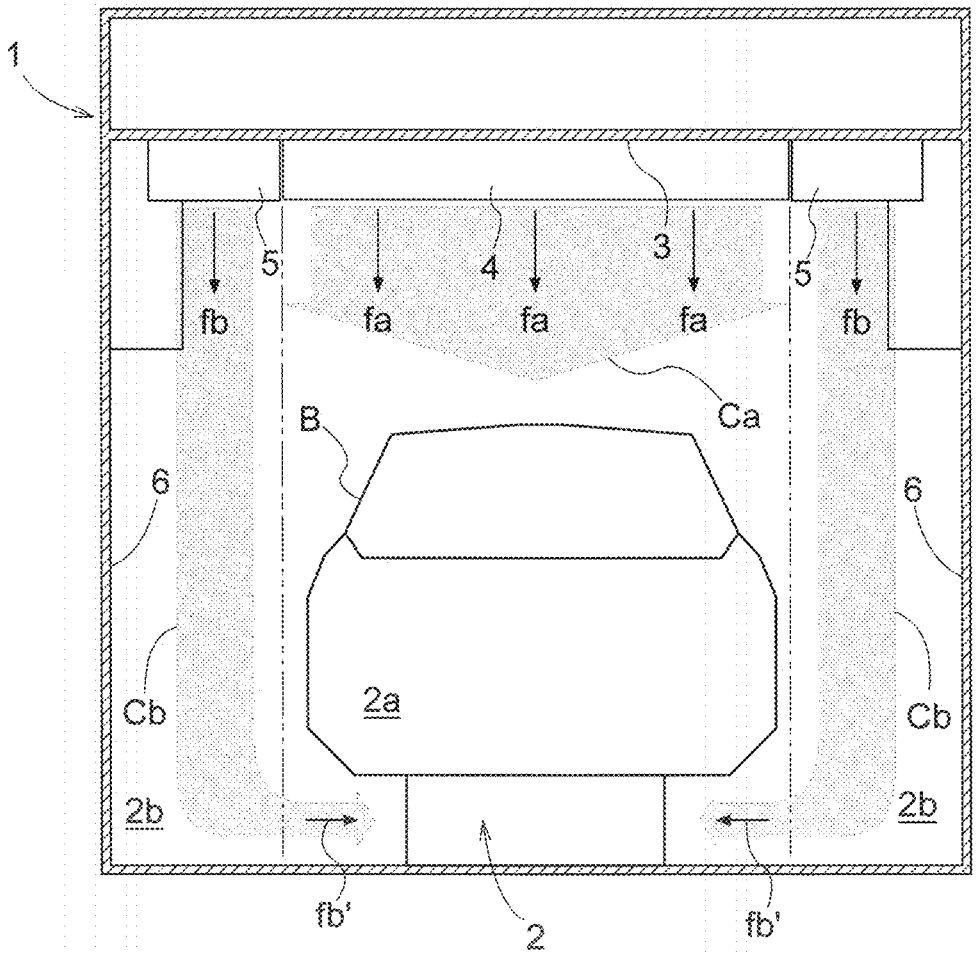
FIG. 7 is a front view showing an airflow state when there is a target object.

That is, as a result of such a blowing manner being employed, in a situation in which a process target object B is in the target object passage region 2*a* of the furnace body opening portion 2, an airflow fa blowing from the central vent 4 flows along an upper surface portion of the process target object B (in this example, a roof portion of the body of an automobile) as shown in FIGS. 6 and 7, because the inclination angle θa relative to the horizontal direction is smaller than 40° and an incident angle θin (=90−θa) relative to the upper surface portion of the process target object B is large.

Therefore, the airflow fa blowing from the central vent 4 is kept from rebounding after colliding with the upper surface portion of the process target object B.

As a result, the airflow fa blowing from the central vent 4 stably forms the airflow curtain Ca, which is not disturbed, above the process target object B.

Therefore, if the process target object B is in the target object passage region 2*a* of the furnace body opening portion 2, leaking of high-temperature gas G from the inside to the outside of the furnace via the upper region of the furnace body opening portion 2 is effectively prevented by the airflow curtain Ca that is stably formed above the process target object B by the airflow fa blowing from the central vent 4 and the airflow curtains Cb that are respectively formed in the left and right gap regions 2*b* by airflows fb blowing from the left and right side vents 5.

Furthermore, since the airflows fb blowing from the left and right side vents 5 are oriented diagonally downward at the inclination angle θb that is larger than 60° relative to the horizontal direction, the airflows fb reach floor portions in the respective gap regions 2*a* while forming the airflow curtains Cb in the gap regions 2*b*, and thereafter portions of the airflows fb effectively flow into the space under the process target object B.

The thus formed airflows fb' flowing into the space under the process target object B prevent normal-temperature air O outside the furnace from passing under the process target object B and entering the furnace.

Therefore, if the process target object B is in the target object passage region 2*a* of the furnace body opening portion 2, entry of normal-temperature air O from the outside to the inside of the furnace via the lower region of the furnace body opening portion 2 is effectively prevented by the airflow curtains Cb that are respectively formed in the gap regions 2*b* by the airflows fb blowing from the left and right side vents 5 and the above-described airflows fb' flowing from the floor portions of the respective gap regions 2*b* into the space under the process target object B.

Figure 4:
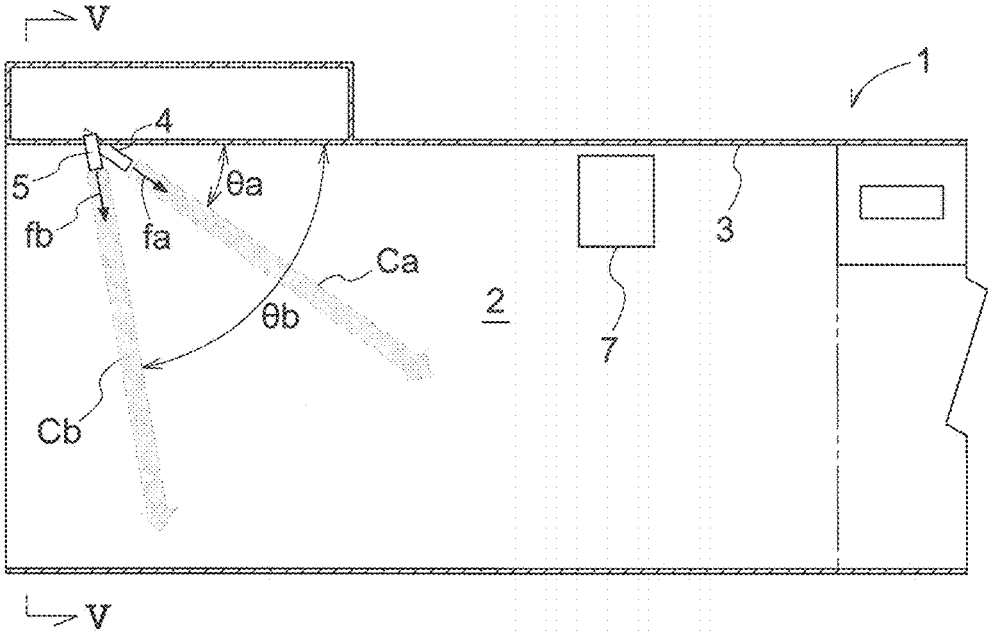
FIG. 4 is a side view showing an airflow state when there is no target object.
Figure 5:
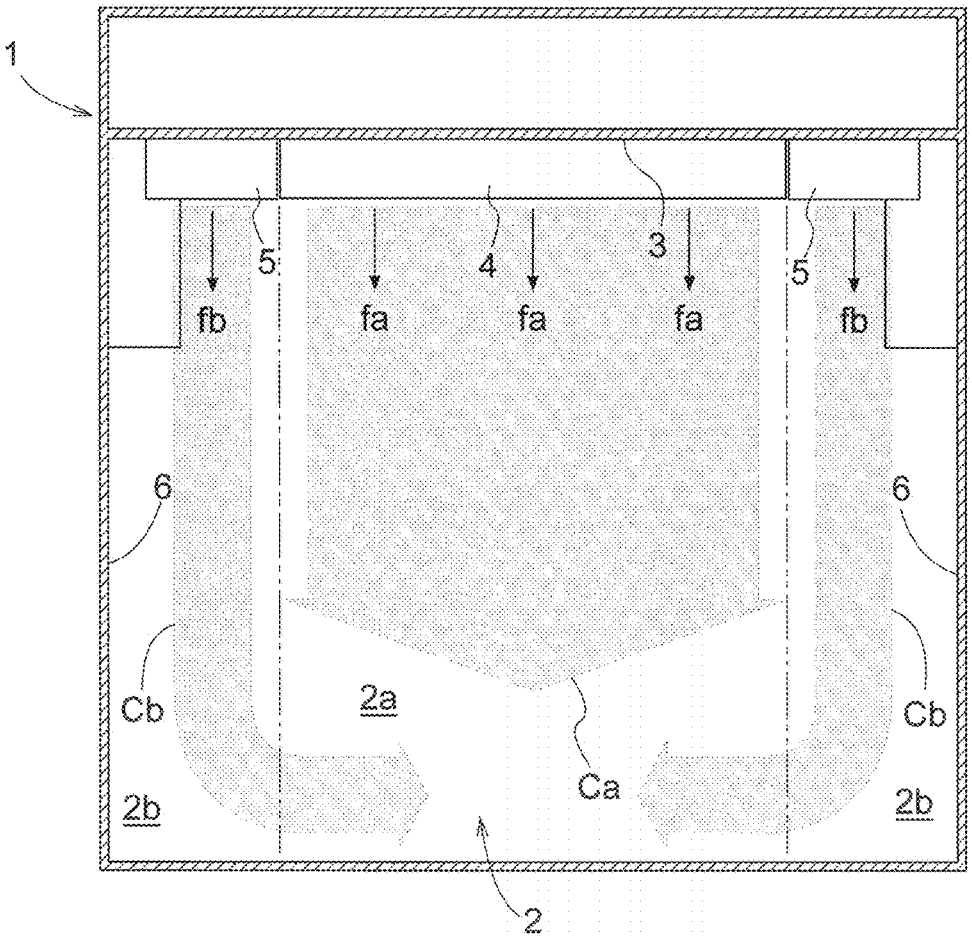
FIG. 5 is a front view showing an airflow state when there is no target object.

On the other hand, if there is no process target object B in the target object passage region 2*a* of the furnace body opening portion 2, as shown in FIGS. 4 and 5, an airflow fa blowing from the central vent 4 toward the inner side of the furnace diagonally downward at the inclination angle θa that is smaller than 40° relative to the horizontal direction forms an airflow curtain Ca in the target object passage region 2*a* while flowing diagonally downward because there is no process target object B, and the airflow fa blowing from the central vent 4 also spreads in the transverse direction of the furnace body opening portion 2 toward the gap regions 2*b*, while forming the airflow curtain Ca, because there is no process target object B.

Further, airflows fb blowing from the left and right side vents 5 toward the inner side of the furnace diagonally downward at the inclination angle θb that is larger than 60° relative to the horizontal direction form airflow curtains Cb respectively in the gap regions 2*b* and, on the outer sides of the furnace with respect to the airflow curtain Ca formed by the airflow fa blowing from the central vent 4, the airflows fb blowing from the left and right side vents 5 also spread in the transverse direction of the furnace body opening portion 2 toward the vehicle body passage region 2*a*, while forming the airflow curtains Cb, because there is no process target object B.

Therefore, if there is no process target object B in the target object passage region 2*a* of the furnace body opening portion 2, the state of the furnace body opening portion 2 is close to a state where double airflow curtains are formed therein.

As a result, leaking of high-temperature gas G from the inside to the outside of the furnace via the upper region of the furnace body opening portion 2 and entry of normal-temperature air O from the outside to the inside of the furnace via the lower region of the furnace body opening portion 2 are effectively prevented.

Figure 8:
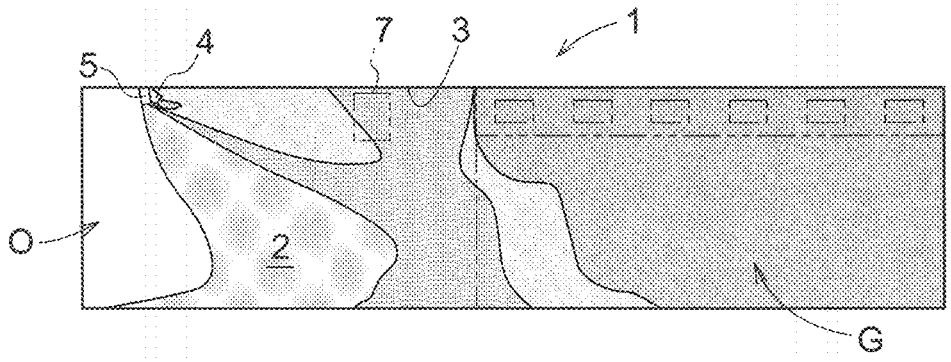
FIG. 8 is a side view showing a temperature distribution state when there is no target object.
Figure 9:
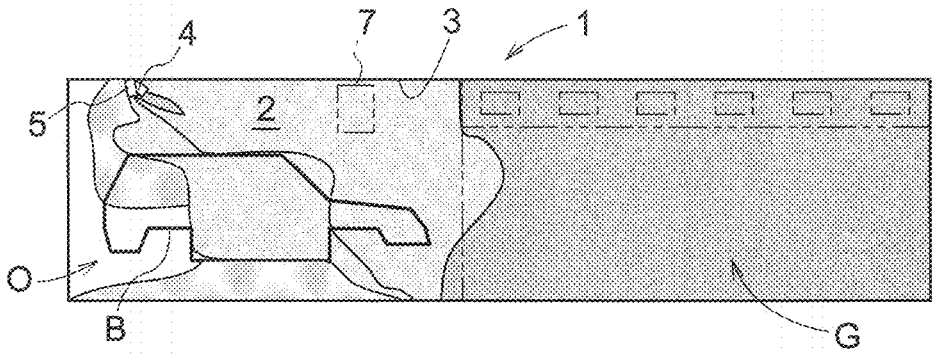
FIG. 9 is a side view showing a temperature distribution state when there is a target object.

It should be noted that FIGS. 8 and 9 show temperature distribution states in a case where an airflow fa for forming an airflow curtain blows from the central vent 4 toward the inner side of the furnace diagonally downward at an inclination angle θa of 35° relative to the horizontal direction and airflows fa for forming airflow curtains blow from the left and right side vents 5 toward the inner side of the furnace diagonally downward at an inclination angle θb of 80° relative to the horizontal direction.

Here, FIG. 8 shows a temperature distribution state in the target object passage region 2*a* of the furnace body opening portion 2 in a case where there is no process target object B in the furnace body opening portion 2.

FIG. 9 shows a temperature distribution state in the target object passage region 2*a* of the furnace body opening portion 2 in a case where a process target object B is in the target object passage region 2*a* of the furnace body opening portion 2.

As is clear from FIGS. 8 and 9, according to the above-described configuration, leaking of high-temperature gas G from the inside to the outside of the furnace and entry of normal-temperature air O from the outside to the inside of the furnace via the furnace body opening portion 2 are effectively prevented in both the case where there is no process target object B in the furnace body opening portion 2 and the case where the process target object B is in the furnace body opening portion 2.

Further, FIGS. 10 to 14 show simulation results in a case where the furnace body opening portion 2 has a width of W=2700 mm, a height of H=2750 mm, and a length of L=5000 mm, the central vent 4 is a slit-shaped opening having a length in a transverse direction of w=1800 mm and a length in a longitudinal direction of d=50 mm, and each of the side vents 5 is a slit-shaped opening having a length in a transverse direction of w=450 mm and a length in a longitudinal direction of d=50 mm.

Figure 10:
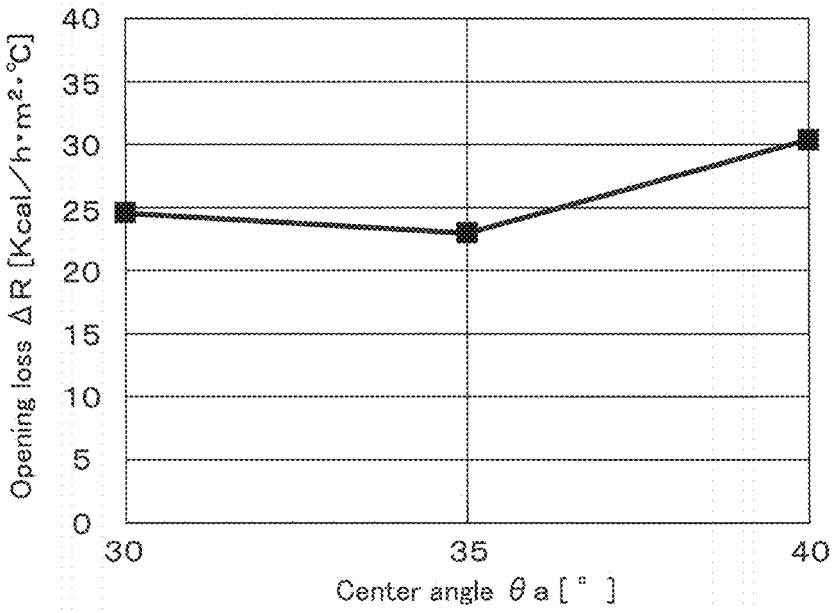
FIG. 10 is a graph showing a correlation between an airflow blowing angle at a central vent and heat loss.

The graph in FIG. 10 shows a relationship between the inclination angle θa and an opening loss ΔR per unit (heat loss via the furnace body opening portion 2 per unit time, unit area, and unit temperature) in a state where the inclination angle θb is fixed.

Figure 11:
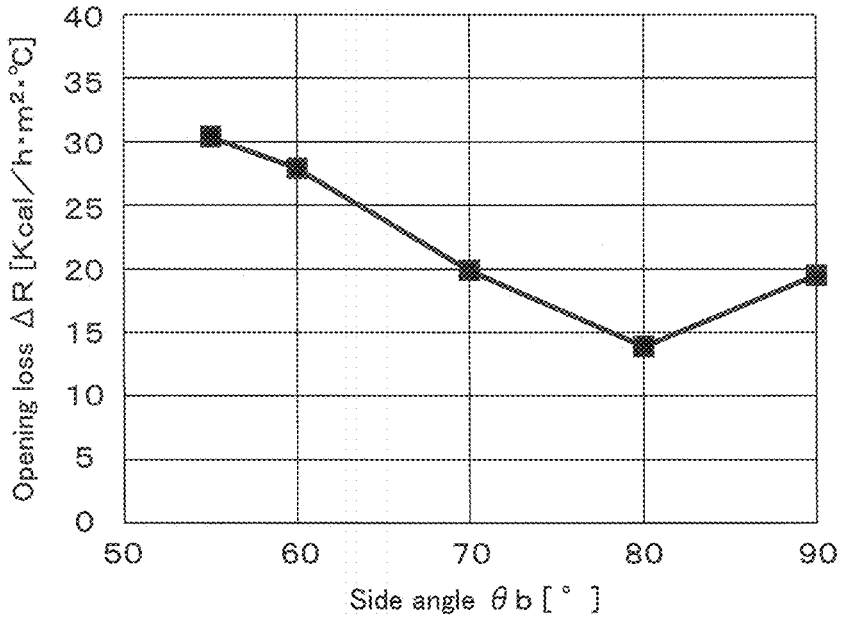
FIG. 11 is a graph showing a correlation between an airflow blowing angle at a side vent and heat loss.

The graph in FIG. 11 shows a relationship between the inclination angle θb and the opening loss ΔR per unit in a state where the inclination angle θa is fixed.

Figure 12:
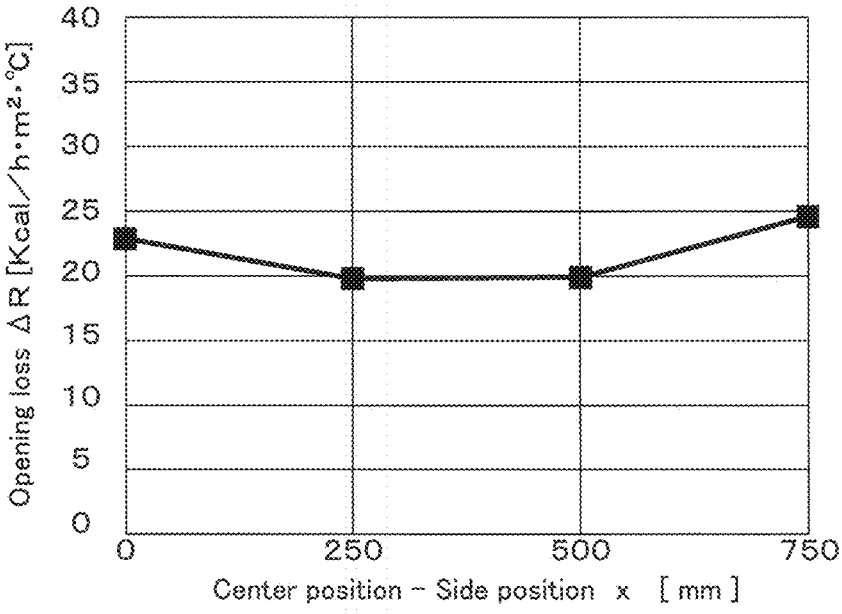
FIG. 12 is a graph showing a correlation between a spacing distance between vents and heat loss.

The graph in FIG. 12 shows a relationship between a spacing distance x between the vents 4 and 5 in a target object conveyance direction and the opening loss ΔR per unit in a case where the central vent 4 is located further toward the inner side of the furnace than the side vents 5 are located.

Figure 13:
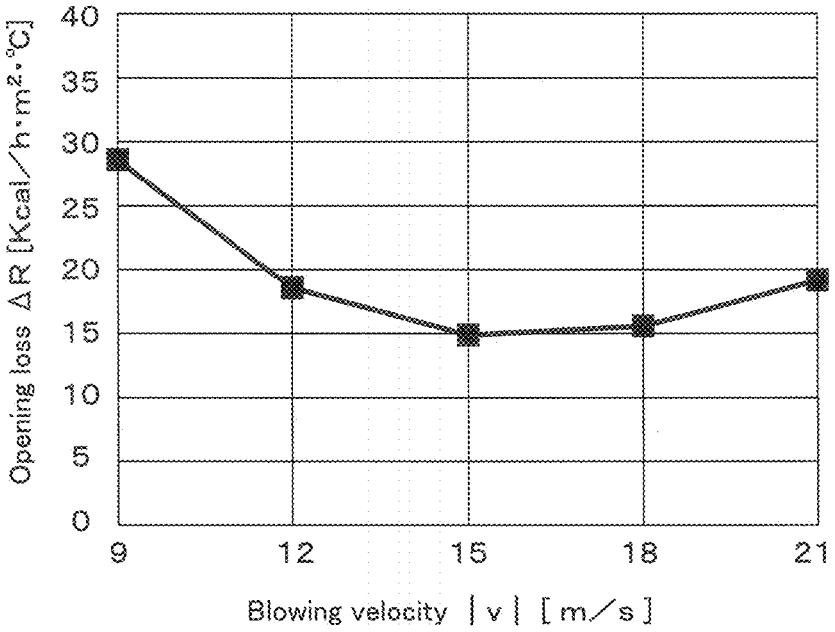
FIG. 13 is a graph showing a correlation between the magnitude of a blowing velocity and heat loss.

The graph in FIG. 13 shows a relationship between the magnitude |V|(=|Va|, |Vb|) of an airflow blowing velocity V and the opening loss ΔR per unit in a case where the magnitude |Va| of an airflow blowing velocity Va at the central vent 4 is equal to the magnitude |Vb| of an airflow blowing velocity Vb at the side vents 5.

Figure 14:
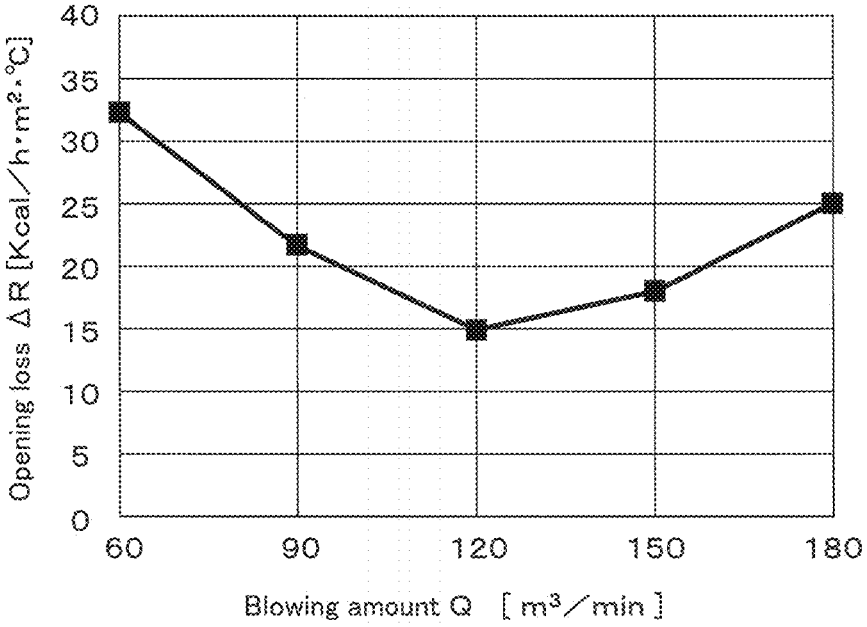
FIG. 14 is a graph showing a correlation between a blowing amount and heat loss.

The graph in FIG. 14 shows a relationship between the sum Q of blowing amounts from the vents 4 and 5 and the opening loss ΔR per unit in a case where blowing amounts from the vents 4 and 5 per unit length w in the transverse direction are equal to each other.

That is, according to these simulation results, it is preferable to employ specifications shown below for the central vent 4 and the side vents 5 in a case where the furnace body opening portion 2 has a width of W=2700 mm, a height of H=2750 mm, and a length of L=5000 mm, the central vent 4 is a slit-shaped opening having a length in the transverse direction of w=1800 mm and a length in the longitudinal direction of d=50 mm, and each of the side vents 5 is a slit-shaped opening having a length in the transverse direction of w=450 mm and a length in the longitudinal direction of d=50 mm.

Inclination angle θa=35°, Inclination angle θb=80°

Spacing distance x=250 mm.

Magnitude of each of the airflow blowing velocities Va and Vb at the respective vents 4 and 5: |V|=15 m/s Blowing amount from the central vent 4 per unit time: Qa=80 $m^3$/min Blowing amount from each of the side vents 5 per unit time: Qb=20 $m^3$/min It should be noted that the central vent 4 is not limited to a single opening that is not divided, and may be a group of divided openings.

Incidentally, each side wall 6 of the furnace body opening portion 2 is provided with an exhaust port 7 that is located in a portion that faces a region 2*c* of the furnace body opening portion 2 (i.e., an inner furnace region of the furnace body opening portion 2) that is located further toward the inner side of the furnace with respect to locations where the above-described airflow curtains Ca and Cb are formed, and gas in the inner furnace region 2*c* is discharged from the exhaust ports 7 to the outside.

That is, when airflows fa and fb blowing from the central vent 4 and the side vents 5 enter the above-described inner furnace region 2*c*, gas in the inner furnace region 2*c* diffuses toward the inner side of the furnace and mixes with high-temperature gas G inside the furnace, but such mixing is prevented if the gas is discharged from the above-described exhaust ports 7.

As a result, the internal temperature of the furnace is more stably kept at a temperature that is suitable for the coating drying process.

Figure 15:
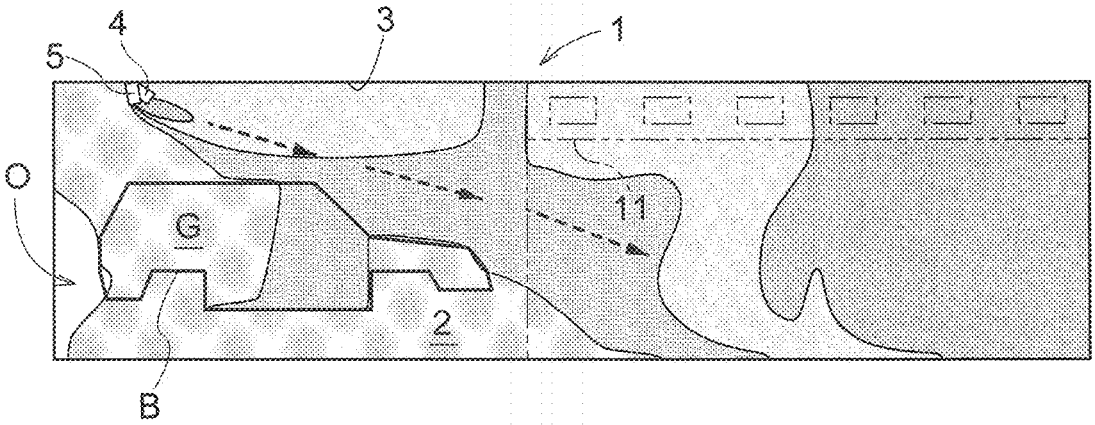
FIG. 15 is a side view showing a temperature distribution state in a situation in which exhaust ports are not provided.

It should be noted that FIG. 15 shows a temperature distribution state in the furnace body opening portion 2 and an inner portion of the furnace in a case where the above-described exhaust ports 7 are not provided.

Figure 16:
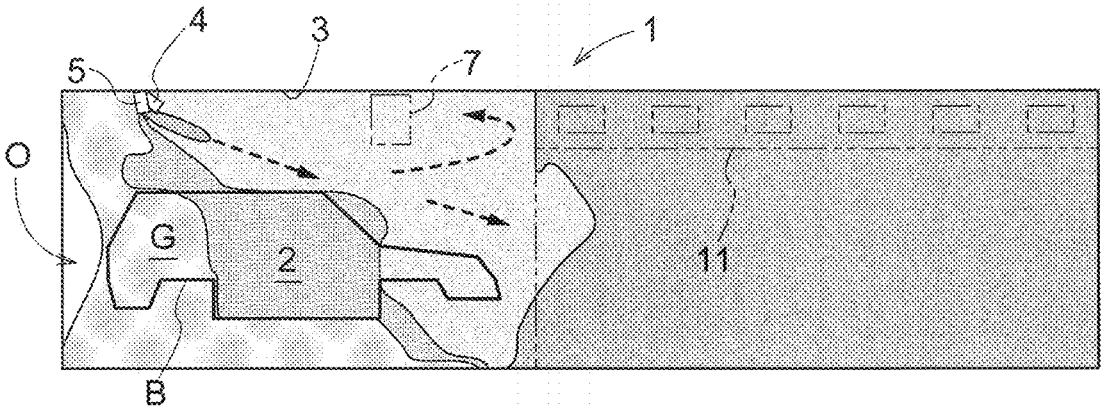
FIG. 16 is a side view showing a temperature distribution state in a situation in which exhaust ports are provided.

Also, FIG. 16 shows a temperature distribution state in the furnace body opening portion 2 and the inner portion of the furnace in a case where the above-described exhaust ports 7 are provided.

As is clear from FIGS. 15 and 16, a reduction in the internal temperature of the furnace is effectively prevented if the above-described exhaust ports 7 are provided.

Airflows fa and fb that are respectively to blow from the central vent 4 and the side vents 5 are heated to a set temperature by a suitable heating means before blowing from the central vent 4 and the side vents 5.

As a result, condensation of tar components in the furnace body opening portion 2 is prevented.

Figure 17:
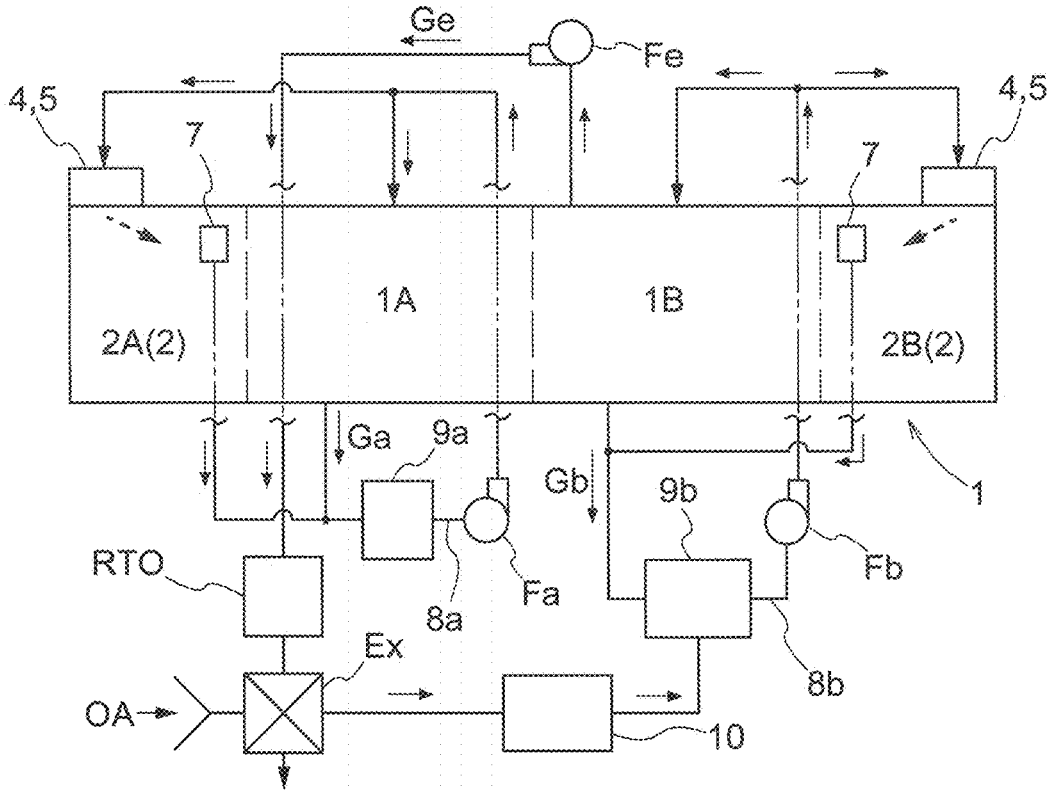
FIG. 17 is a circuit diagram showing a first example of a heating method.
Figure 18:
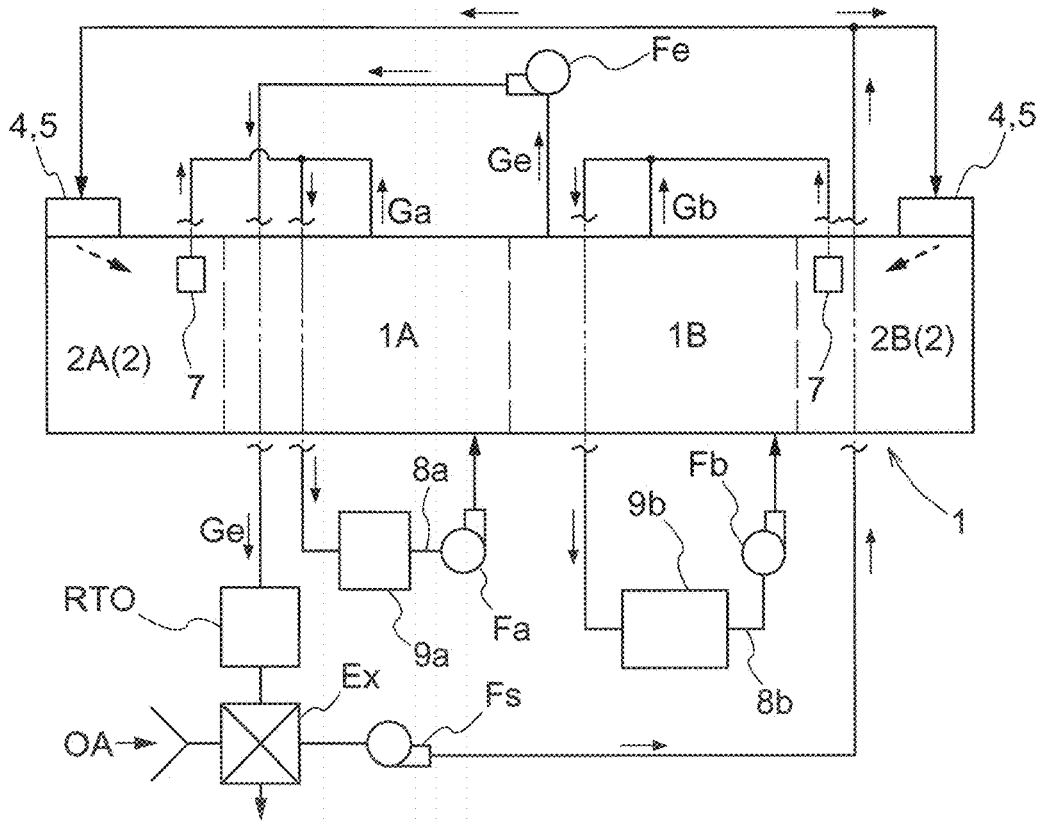
FIG. 18 is a circuit diagram showing a second example of the heating method.
Figure 19:
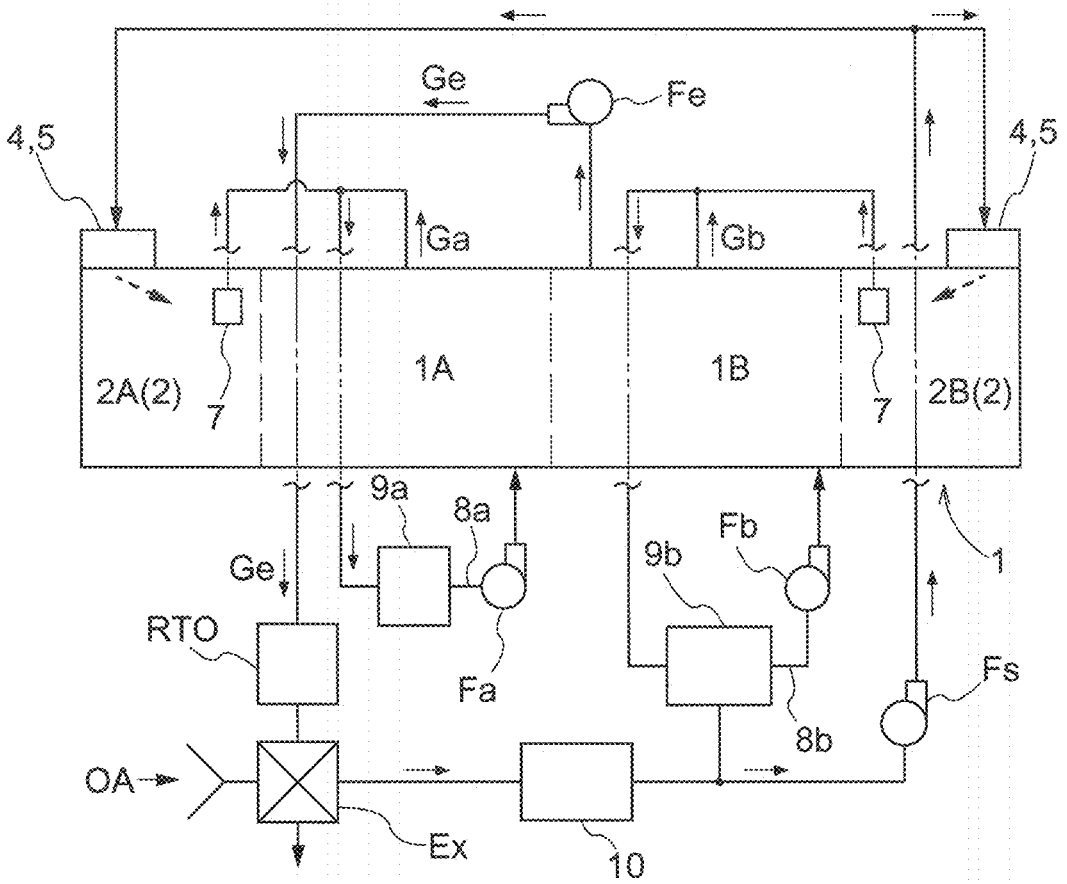
FIG. 19 is a circuit diagram showing a third example of the heating method.

FIGS. 17 to 19 show first to third examples of an airflow heating method.

In each of the figures, 2A denotes an inlet-side furnace body opening portion, 2B denotes an outlet-side furnace body opening portion, 1A denotes a heating zone on the inlet side in the furnace, and 1B denotes a temperature retaining zone on the outlet side in the furnace.

It should be noted that, in the heating zone 1A, the process target object B conveyed into the furnace is heated to a temperature that is suitable for the coating drying process through heating performed in the zone 1A.

On the other hand, in the temperature retaining zone 1B, the process target object B heated in the heating zone 1A is kept at the temperature suitable for the coating drying process through heating performed in the zone 1B.

In all of the first to third examples shown in FIGS. 17 to 19, essentially, high-temperature exhaust gas Ge that is discharged from the furnace using an exhaust fan Fe is cleaned by a heat reserving type gas processing device RTO (Regenerative Thermal Oxidaizer).

The high-temperature exhaust gas Ge cleaned by the heat reserving type gas processing device RTO is discharged to the outside after heat is recovered from the high-temperature exhaust gas Ge to fresh outside air OA through heat exchange performed using the fresh outside air OA in an exhaust gas heat exchanger Ex.

Also, high-temperature gases Ga and Gb are respectively circulated through circulation paths 8*a* and 8*b* in the heating zone 1A and the temperature retaining zone 1B by operations of circulation fans Fa and Fb.

As a result of the circulated high-temperature gases Ga and Gb being heated in heating furnaces 9*a* and 9*b* that are provided on the circulation paths 8*a* and 8*b*, the temperatures of the heating zone 1A and the temperature retaining zone 1B are kept at predetermined temperatures.

Further, exhaust gas discharged from the exhaust ports 7 provided in the inner furnace region 2*c* of the inlet-side furnace body opening portion 2A merges with high-temperature gas Ga taken out of the heating zone 1A into the circulation path 8*a* and is introduced into the heating furnace 9*a*.

Similarly, exhaust gas discharged from the exhaust ports 7 provided in the inner furnace region 2*c* of the outlet-side furnace body opening portion 2B merges with high-temperature gas Gb taken out of the temperature retaining zone 1B into the circulation path 8*b* and is introduced into the heating furnace 9*b*.

In addition to the above-described common basic configuration, the first example shown in FIG. 17 has a configuration in which a portion of circulated high-temperature gas Ga that has passed through the heating furnace 9*a* and the circulation fan Fa on the heating zone 1A side circulation path 8*a* (i.e., circulated high-temperature gas Ga to be returned to the heating zone 1A) is supplied to the central vent 4 and the side vents 5 in the inlet-side furnace body opening portion 2A, as heated airflows fa and fb to blow from the vents 4 and 5.

Similarly, a portion of circulated high-temperature gas Gb that has passed through the heating furnace 9*b* and the circulation fan Fb on the temperature retaining zone 1B side circulation path 8*b* (i.e., circulated high-temperature gas Gb to be returned to the temperature retaining zone 1B) is supplied to the central vent 4 and the side vents 5 in the outlet-side furnace body opening portion 2B, as heated airflows fa and fb to blow from the vents 4 and 5.

It should be noted that, in the first example, fresh outside air OA to which heat is recovered from high-temperature exhaust gas Ge through heat exchange performed in the exhaust gas heat exchanger Ex is further heated by a burner 10, and is then supplied to the temperature retaining zone 1B side heating furnace 9*b*, as combustion air to be used by a heating burner of the temperature retaining zone 1B side heating furnace 9*b*.

On the other hand, in the second example shown in FIG. 18, fresh outside air OA to which heat is recovered from high-temperature exhaust gas Ge through heat exchange performed in the exhaust gas heat exchanger Ex is supplied by a feeding fan Fs to the central vents 4 and the side vents 5 in the inlet-side and outlet-side furnace body opening portions 2A and 2B, as heated airflows fa and fb to blow from the vents 4 and 5.

The third example shown in FIG. 19 is a combination of the first example and the second example, in which fresh outside air OA to which heat is recovered from high-temperature exhaust gas Ge through heat exchange performed in the exhaust gas heat exchanger Ex is further heated by the burner 10.

Further, a portion of the outside air OA heated by the burner is supplied to the temperature retaining zone 1B side heating furnace 9*b* as combustion air to be used by the heating burner of the temperature retaining zone 1B side heating furnace 9*b*.

On the other hand, the remaining portion of the outside air OA heated by the burner is supplied by the feeding fan Fs to the central vents 4 and the side vents 5 in the inlet-side and outlet-side furnace body opening portions 2A and 2B, as heated airflows fa and fb to blow from the vents 4 and 5.

OTHER EMBODIMENTS

Next, other embodiments of the present invention will be listed.

The specific structure of the central vent 4 that forms an airflow curtain in the target object passage region 2*a* of the furnace body opening portion 2 is not limited to the structure described in the above embodiment and may be any structure so long as an airflow fa for forming an airflow curtain blows from the central vent 4 toward the inner side of the furnace diagonally downward at the inclination angle θa that is smaller than 40° (preferably, $30° \leq \theta a < 40°$) relative to the horizontal direction.

Similarly, the specific structure of the side vents 5 that form airflow curtains in the gap regions 2*b* of the furnace body opening portion 2 is not limited to the structure described in the above embodiment and may be any structure so long as airflows fb for forming airflow curtains blow from the side vents 5 toward the inner side of the furnace diagonally downward at the inclination angle θb that is larger than 60° ($\theta b > 60°$) relative to the horizontal direction.

Also, the side vents 5 may be configured such that airflows fb for forming airflow curtains blow vertically downward from the side vents 5.

In the above embodiment, an example is described in which the exhaust ports 7 for discharging gas from the inner furnace region 2*c* of the furnace body opening portion 2 (i.e., the region of the furnace body opening portion 2 that is located further toward the inner side of the furnace with respect to locations where airflow curtains are formed) are provided in the side walls 6 of the furnace body opening portion 2.

However, this is not a limitation, and the ceiling portion 3 of the furnace body opening portion 2 may be provided with exhaust ports 7, in a portion of the ceiling portion 3 that faces the inner furnace region 2*c*, for example.

Figure 20:
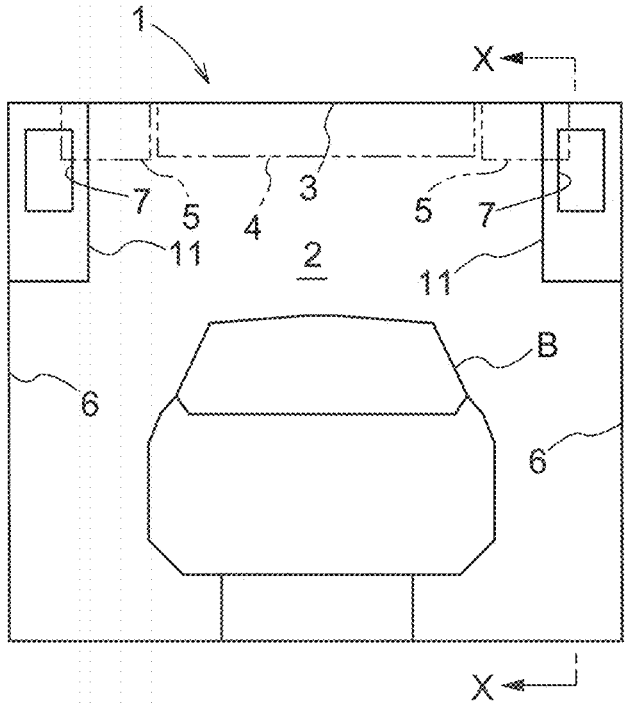
FIG. 20 is a front view of a furnace body opening portion showing another embodiment.
Figure 21:
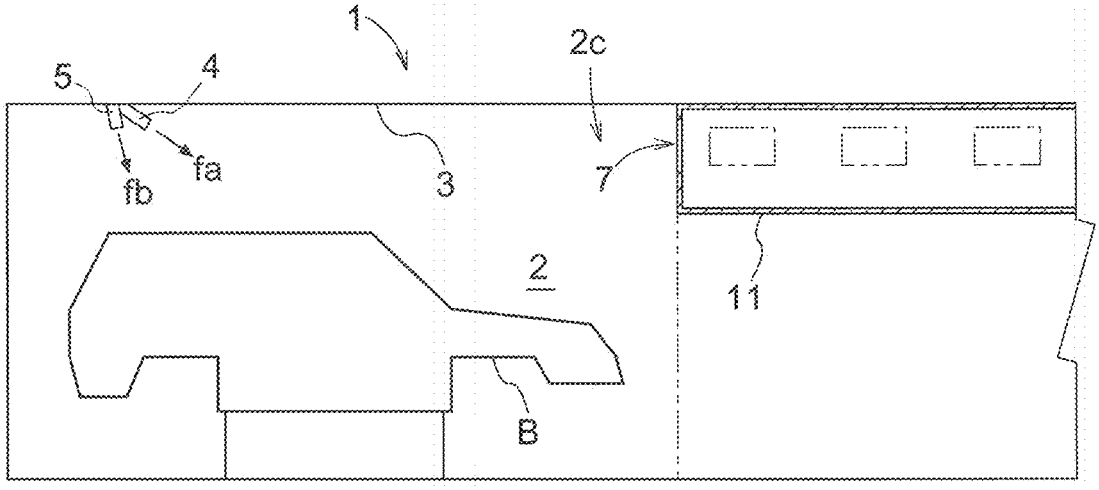
FIG. 21 is a cross-sectional view taken along line X-X in FIG. 20.

Alternatively, as shown in FIGS. 20 and 21, wall members that form exhaust chambers 11 arranged in the furnace may be provided with exhaust ports 7, in portions of the wall members that face the inner furnace region 2*c* of the furnace body opening portion 2.

It should be noted that the above-described exhaust chambers 11 are chambers for removing high-temperature gases Ga and Gb inside the zones 1A and 1B of the furnace, which are circulated through the above-described circulation paths 8*a* and 8*b*, from the zones 1A and 1B.

Figure 22:
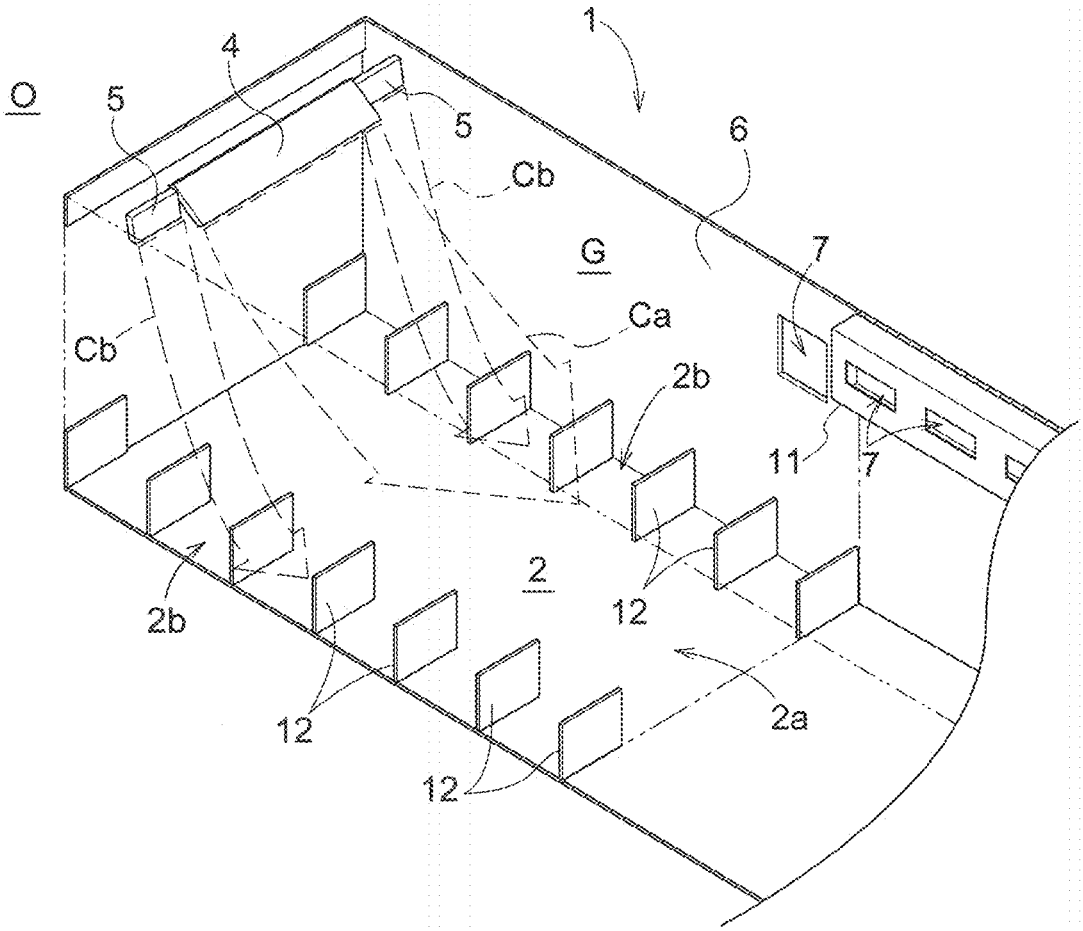
FIG. 22 is a perspective view showing another embodiment.

As shown in FIG. 22, a plurality of upright walls 12 that are perpendicular to the target object conveyance direction may be arranged at predetermined intervals in the target object conveyance direction in each of the gap regions 2*b* of the furnace body opening portion 2.

These upright walls 12 assist in the prevention of leaking of high-temperature gas G inside the furnace and entry of normal-temperature air O outside the furnace by the airflow curtains Ca and Cb.

Although an example is described in the above embodiment in which the process target object B is the body of an automobile that has been subjected to a coating step, the process target object B in the present invention is not limited to the body of an automobile and may be any object that needs to be subjected to a coating drying process, and examples of the process target object include an automobile component such as a bumper, a casing of an electric appliance, a building material, and a railroad car.

Also, the present invention is not required to be applied to both the inlet-side furnace body opening portion 2 (2A) and the outlet-side furnace body opening portion 2 (2B) of the tunnel-shaped furnace body 1, and a configuration is also possible in which the present invention is applied to only one of the furnace body opening portions 2.

INDUSTRIAL APPLICABILITY

The coating drying furnace according to the present invention can be used for a coating drying process performed on various articles in various fields.

DESCRIPTION OF REFERENCE SIGNS

B: Process target object
2: Furnace body opening portion
3: Ceiling portion
2*a*: Target object passage region
Ca: Airflow curtain
4: Central vent
6: Side wall
2*b*: Gap region
Cb: Airflow curtain
5: Side vent
θa: Inclination angle
fa: Airflow
θb: Inclination angle
fb: Airflow
2*c*: Inner furnace region
7: Exhaust port

The invention claimed is:

1. A coating drying furnace comprising vents for forming airflow curtains that are provided in a ceiling portion of a furnace body opening portion through which a process target object to be conveyed from an outside to an inside of the furnace or a processed process target object to be conveyed from the inside to the outside of the furnace passes, wherein airflow curtains that are formed in the furnace body opening portion by airflows blowing from the vents prevent high-temperature gas inside the furnace from leaking to the outside of the furnace via the furnace body opening portion and prevent normal-temperature air outside the furnace from entering the furnace via the furnace body opening portion, the coating drying furnace comprising, as the vents:

a central vent configured to form an airflow curtain in a target object passage region of the furnace body opening portion; and left and right side vents configured to form airflow curtains respectively in gap regions between the target object passage region and left and right side walls of the furnace body opening portion, wherein an airflow for forming an airflow curtain blows from the central vent toward an inner side of the furnace diagonally downward at an inclination angle that is smaller than 40° relative to a horizontal direction, and airflows for forming airflow curtains blow from the left and right side vents vertically downward or toward the inner side of the furnace diagonally downward at an inclination angle that is larger than 60° relative to the horizontal direction.

2. The coating drying furnace according to claim 1, wherein an inclination angle of an airflow blowing from the central vent relative to the horizontal direction is an inclination angle at which heat loss via the furnace body opening portion is minimum in a correlation between the inclination angle and the heat loss.

3. The coating drying furnace according to claim 1, wherein an inclination angle of airflows blowing from the side vents relative to the horizontal direction is an inclination angle at which heat loss via the furnace body opening portion is minimum in a correlation between the inclination angle and the heat loss.

4. The coating drying furnace according to claim 1, wherein, in a region of the furnace body opening portion that is located further toward the inner side of the furnace with respect to locations where the airflow curtains are formed, an exhaust port for discharging gas from the region is provided.

5. The coating drying furnace according to claim 1, wherein, in a target object conveyance direction, the central vent is located further toward the inner side of the furnace than the side vents are located, and a spacing distance between the central vent and the side vents in the target object conveyance direction is a spacing distance at which heat loss via the furnace body opening portion is minimum in a correlation between the spacing distance and the heat loss.

6. The coating drying furnace according to claim 1, wherein a magnitude of an airflow blowing velocity at the central vent and a magnitude of an airflow blowing velocity at the side vents are equal to each other.

7. The coating drying furnace according to claim 1, wherein airflows that are heated to a set temperature by a heater blow from the central vent and the side vents.

8. The coating drying furnace according to claim 1, wherein the process target object is a body of an automobile.

* * * * *